US009526953B2

(12) United States Patent
Cackett et al.

(10) Patent No.: US 9,526,953 B2
(45) Date of Patent: Dec. 27, 2016

(54) HOSEL CONSTRUCTION

(71) Applicant: CALLAWAY GOLF COMPANY, Carlsbad, CA (US)

(72) Inventors: Matthew T. Cackett, San Diego, CA (US); Sean P. Griffin, Encinitas, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

(21) Appl. No.: 14/858,891

(22) Filed: Sep. 18, 2015

(65) Prior Publication Data

US 2016/0008674 A1 Jan. 14, 2016

Related U.S. Application Data

(60) Division of application No. 14/072,055, filed on Nov. 5, 2013, now abandoned, which is a continuation of application No. 13/104,675, filed on May 10, 2011, now abandoned.

(60) Provisional application No. 61/333,992, filed on May 12, 2010.

(51) Int. Cl.
*A63B 53/02* (2015.01)
*A63B 53/04* (2015.01)

(52) U.S. Cl.
CPC ..... *A63B 53/02* (2013.01); *A63B 53/0466* (2013.01); *A63B 53/047* (2013.01); *A63B 2053/0408* (2013.01); *A63B 2209/00* (2013.01)

(58) Field of Classification Search
CPC . A63B 53/02; A63B 53/0466; A63B 2209/00; A63B 2053/0408; A63B 53/047
See application file for complete search history.

(56) References Cited

U.S. PATENT DOCUMENTS 1,829,900 A * 11/1931 Johnson ..... A63B 53/02 473/308
3,191,936 A * 6/1965 Guier ..... A63B 53/007 403/263
4,123,055 A * 10/1978 Brill ..... A63B 53/00 473/204
4,432,549 A * 2/1984 Zebelean ..... A63B 53/04 473/345
4,512,577 A * 4/1985 Solheim ..... A63B 53/04 473/290
4,809,983 A * 3/1989 Langert ..... A63B 53/02 473/305
4,991,843 A * 2/1991 Mori ..... A63B 53/04 473/312

(Continued)

*Primary Examiner* — Stephen Blau
(74) *Attorney, Agent, or Firm* — Rebecca Hanovice; Michael Catania; Sonia Lari

(57) ABSTRACT

The present invention relates to a hosel for connecting a shaft to a club head. In one aspect of the invention, the hosel comprises a body having an undercut, wherein the undercut has a maximum cross section which tapers to a minimum cross section and increases to the maximum cross section immediately adjacent the club head. The hosel further comprises a flange section below the hosel and hosel bore above the undercut, the hosel bore section having a length of at least one inch. In another aspect of the invention, the hosel tapers in diameter from a maximum to a minimum width, and has a maximized interior mold line (IML) to improve bendability and weight savings.

8 Claims, 6 Drawing Sheets

(56) References Cited

U.S. PATENT DOCUMENTS 5,060,949 A * 10/1991 Brill ..... A63B 53/04 473/328
5,184,819 A * 2/1993 Desbiolles ..... A63B 53/02 473/309
5,324,033 A * 6/1994 Fenton, Jr. ..... A63B 53/02 473/305
5,451,048 A * 9/1995 Magamoto ..... A63B 53/02 473/324
5,556,097 A * 9/1996 Endo ..... A63B 53/02 473/309
5,586,944 A * 12/1996 Nagamoto ..... A63B 53/02 473/248
5,626,528 A * 5/1997 Toulon ..... A63B 53/02 473/248
5,647,807 A * 7/1997 Nagamoto ..... A63B 53/02 473/305
6,050,903 A * 4/2000 Lake ..... A63B 53/02 473/244
6,186,903 B1 * 2/2001 Beebe ..... A63B 53/02 473/248
6,341,690 B1 * 1/2002 Swiatosz ..... A63B 55/408 206/315.3
6,669,577 B1 * 12/2003 Hocknell ..... A63B 53/0466 473/329
6,890,266 B2 * 5/2005 Solheim ..... A63B 53/02 473/246
7,955,188 B2 * 6/2011 Bennett ..... A63B 53/02 473/324
8,561,876 B2 * 10/2013 Yamamoto ..... A63B 53/02 228/101
2004/0204264 A1 * 10/2004 Matsunaga ..... A63B 53/0466 473/345
2005/0085313 A1 * 4/2005 Nishitani ..... A63B 53/02 473/305
2008/0113825 A1 * 5/2008 Funayama ..... A63B 53/0466 473/291
2008/0153622 A1 * 6/2008 Watanabe ..... A63B 53/02 473/324
2009/0042665 A1 * 2/2009 Morales ..... A63B 53/02 473/305
2013/0190103 A1 * 7/2013 Rice ..... A63B 53/02 473/334
2014/0106894 A1 * 4/2014 Murphy ..... A63B 53/02 473/314
2015/0011325 A1 * 1/2015 Rice ..... A63B 53/02 473/311
2015/0165281 A1 * 6/2015 Ines ..... A63B 53/047 473/291

* cited by examiner

HOSEL CONSTRUCTION

CROSS REFERENCES TO RELATED APPLICATIONS

The present application is a divisional of U.S. patent application Ser. No. 14/072,055, filed on Nov. 5, 2013, which is a continuation of U.S. patent application Ser. No. 13/104,675, filed on May 10, 2011, now abandoned, which claims priority to U.S. Provisional Patent Application No. 61/333,992, filed on May 12, 2010.

STATEMENT REGARDING FEDERALLY SPONSORED RESEARCH OR DEVELOPMENT

Not Applicable

BACKGROUND OF THE INVENTION

Field of the Invention

The present invention relates generally to a golf club head with a hosel having a cross-sectional diameter that is conducive to bending.

Description of Related Art

The USGA Rules of Golf limit set forth certain structural limits for conforming golf clubs. For example, Appendix II, Rule 2(c) states that, for non-putter clubs, a "shaft must be attached to the clubhead at the heel either directly or through a single plain neck and/or socket. The length from the top of the neck and/or socket to the sole of the club must not exceed 5 inches (127 mm), measured along the axis of, and following any bend in, the neck and/or socket."

Golf club hosels typically are cylindrical in cross section and are consistent in width, which provides support for the shaft but resists bending. Adjustable hosels currently are very popular among golfers, so there is a need to provide golf club hosels that can be adjusted or bent to change the angle of the shaft with respect to the golf club head without sacrificing structural integrity.

BRIEF SUMMARY OF THE INVENTION

The present invention relates to a hosel for connecting a shaft to a club head. One aspect of the present invention is a hosel for connecting a shaft to a club head, the hosel comprising a body having an undercut and a hosel bore, wherein the hosel bore is located above the undercut, wherein the hosel bore has a length of at least one inch, and wherein the undercut has a maximum cross section which tapers to a minimum cross section and increases to the maximum cross section immediately adjacent the club head. The undercut may extend a full 360 degrees around the body, or it may extend only partially around the body. The vertical length of the undercut may be from 0.025 to 1.500 inches, and the invention may further comprise a split collar sized to mask the undercut.

The club head may further comprise a flange section located immediately below the hosel, and the flange section may have a thickness of 0.020 to 0.050 inch. The club head may also comprise an interior hollow section that is separated from the hosel bore by a barrier, which may be approximately 0.040 inch thick, and the interior hollow section may extend upwards into the hosel towards the hosel bore. The undercut of this aspect of the invention may have a curved cross-sectional shape or a polygonal cross-sectional shape.

Another aspect of the present invention is a hosel for connecting a shaft for a club head, the hosel comprising a body having a maximum diameter and a minimum diameter and a hosel bore, wherein the hosel bore has a length of at least one inch, and wherein the hosel bore is encircled by a portion of the body having the minimum diameter. The maximum diameter may be approximately 0.50 inch, the minimum diameter may be approximately 0.47 inch, and the hosel bore may be approximately 1.53 inches in length. The hosel club head may further comprise a flange section located immediately below the hosel, and the flange section may have a thickness of 0.020 to 0.050 inch. The club head may also comprise an interior hollow section that flanks the hosel bore on first and second sides, and wherein the interior hollow section is separated from the hosel bore by a barrier on the first and second sides. The barrier flanking the first side may be approximately 0.040 inch thick, and the barrier flanking the second side may be approximately 0.029 inch thick.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
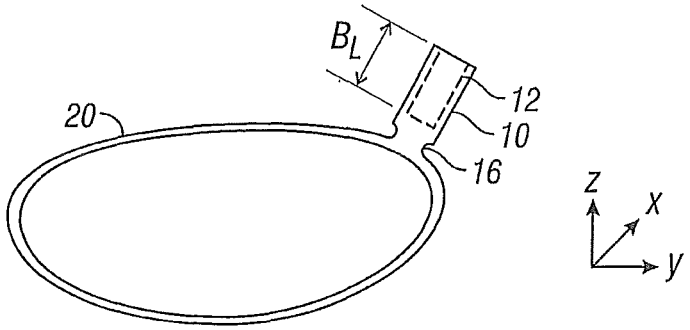
FIG. 1 is a front perspective view of a golf club head according to a first embodiment of the present invention.
Figure 2:
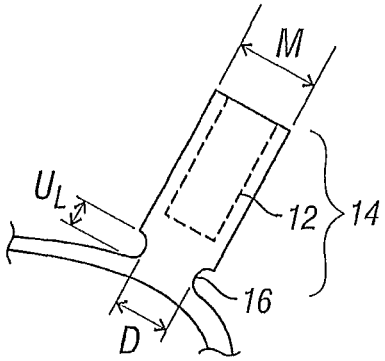
FIG. 2 is an enlarged view of a portion of the embodiment shown in FIG. 1.

The present invention relates to a golf club head having a hosel with a variable cross-sectional diameter that is thick enough to withstand golf club swing and impact loads, and thin enough to bend without distorting other structural features of the golf club.

In some embodiments, shown in FIGS. 1-6 and 8, the cross-sectional diameter of the hosel decreases and increases rapidly over a short distance, such that an undercut is formed at least partially or completely (360 degrees) around the circumference of the hosel. In other embodiments, the cross-sectional diameter of the hosel gently changes or tapers, as shown in FIGS. 9-18. The hosel diameter may taper down (decrease in diameter) from a top end towards a middle portion, and then taper up (increase in diameter) again towards the club head, or may taper down (decrease in diameter) in only one direction. In yet other embodiments, the hosel has a more obviously decreasing cross-section, such that the hosel has a noticeably thinner cross-sectional diameter at one portion than at another portion. Each of these embodiments improves the bendability of the hosel, and thus a golfer's ability to adjust the angle of the hosel with respect to the golf club head, without undermining the overall structural integrity of the hosel.

FIGS. 1-6 and 8 disclose a golf club head 20 having a hosel 10 for connecting a shaft (not shown) to a club head 20. The hosel 10 has a body 14 and an undercut portion 16 that preferably extends at least partially around the circumference of the hosel 10, and in some embodiments a full 360 degrees around the circumference of the hosel 10. The undercut 16 permits a golfer to bend the hosel 10 to have a desired angle with respect to the golf club head 20. The undercut 16 preferably has an overall vertical length $U_L$ of 0.025 inch to 1.5 inch along the hosel 10. The undercut 16 has a maximum cross sectional diameter "M" which tapers to a minimum cross sectional diameter "D" and then increases in cross-sectional diameter adjacent the club head 20. In an exemplary embodiment, shown in FIG. 6, the undercut 16 tapers to a minimum cross-section "D" and then increases in diameter to the maximum cross-section "M," such that the hosel has maximum cross section "M" where it intersects with the golf club head 20. The hosels shown in FIGS. 4 and 8 also have this type of undercut. A hosel undercut 16 is most bendable when the overall vertical length $U_L$ is large, and when the width D of the undercut 16 region remains constant. As such, the embodiment shown in FIG. 8A is more bendable than the embodiment shown in FIG. 8B.

In other embodiments, shown in FIGS. 1-3 and 5, the undercut tapers to a minimum cross-section "D" and begins to increase in cross-sectional diameter, but does not reach maximum cross-section "M" before the hosel intersects with the golf club head 20. In yet another embodiment, shown in FIG. 5, the undercut 16 tapers to minimum diameter "D" and then does not increase in diameter, but instead extends downwards towards the club head 20 such that the hosel has a diameter "D" when it connects with the club head 20.

Figure 7:
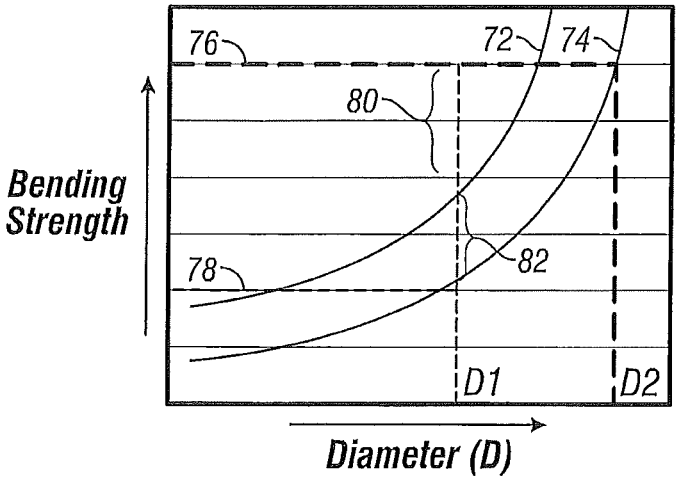
FIG. 7 is a graph that shows the bending strength of a hosel according to the present invention as a function of the width of the tapered region, "D".
Figures 8A, 8B, 8C, 8D:
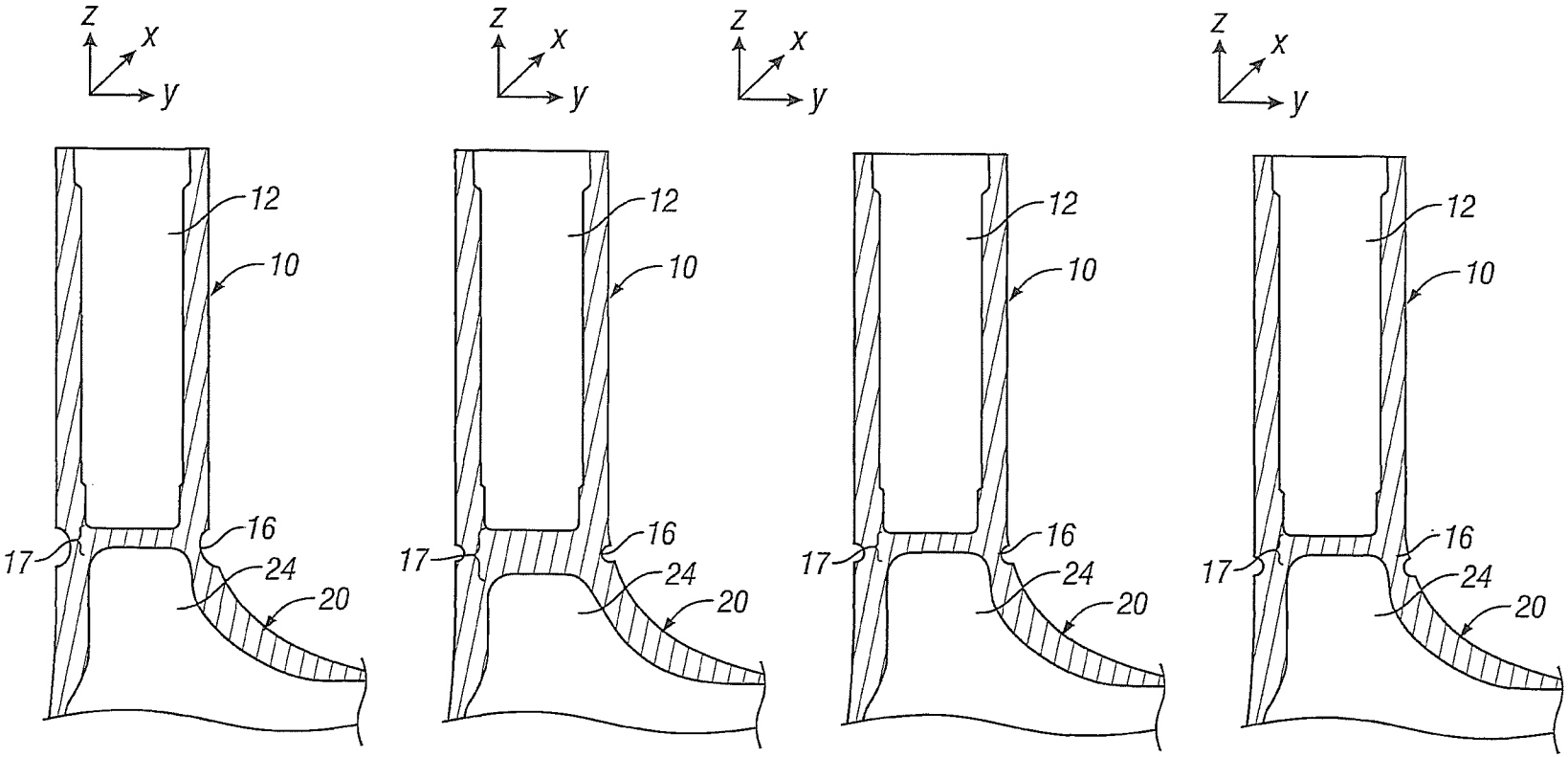
FIGS. 8A, 8B, 8C, and 8D are cross-sectional views of four different embodiments of the present invention.

FIG. 7 discloses the relationship between the diameter "D" in inches of the undercut portion 16 and the bending strength, in pounds δ, of the hosel 10. The maximum bend load 78 is contrasted with the available bending load 76. The yield curve at a smaller diameter ($D_1$) 72 has a greater bending load than a yield curve at a larger diameter ($D_2$) 74, and the bending yield 80 is contrasted with the margin of bending 82 available between $D_1$ and $D_2$. This figure shows that the bendability of the hosel 10 increases as D decreases and/or $U_L$ increases.

The hosel 10 includes an interior hosel bore 12 that is sized to receive the tip end of a shaft (not shown). The hosel bore 12 preferably has a depth $B_L$ of at least one inch. The shaft preferably is bonded to the hosel bore 12 with an adhesive, but may also be mechanically attached via a fastener (not shown). The hosel bore 12 preferably is located in a region of the hosel 10 above the undercut 16, as shown in FIGS. 1-6 and 8, but in other embodiments the hosel bore 12 may be encircled by the undercut.

The interior mold line (IML) of the hosel bore 12 preferably is designed so that the hosel includes the least amount of material as possible, which decreases the overall weight of the club head. In other words, it is beneficial to have a hosel 10 with a large hosel bore 12 IML. This can be achieved by having a hosel bore 12 with greater depth $B_L$. For instance, the hosel 10 in FIG. 1 has more material in it than the hosels 10 in FIG. 8 due to the greater depth of the hosel bores 12 in the embodiments shown in FIG. 8. The overall IML of the hosel 10 in FIG. 1 thus is smaller than the IML of the hosels 10 in FIG. 8.

Figure 4:
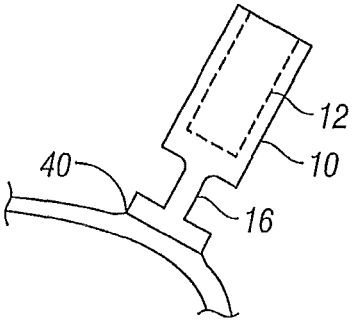
FIG. 4 is a plan view of a hosel according to a second embodiment of the present invention.

As shown in FIG. 4, the hosel 10 preferably is connected to the golf club 20 head through laser welding, forming a weld bead or weld line 40. In alternative embodiments, the hosel 10 is integrally formed with the rest of the golf club head 20 or mechanically attached to the head 20.

Figure 6:
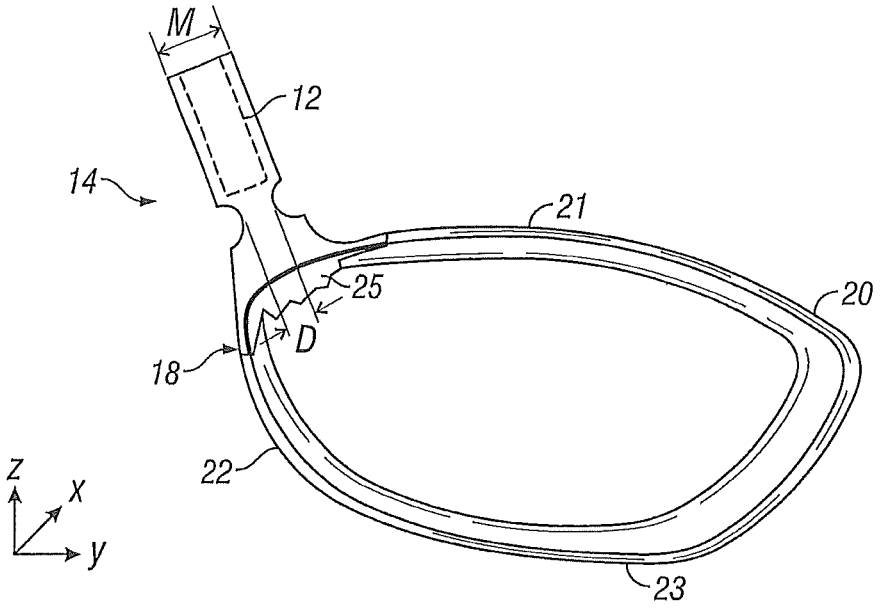
FIG. 6 is a front perspective view of a golf club head according to a fourth embodiment of the present invention.

The golf club head 20 also preferably includes a flange 18, a portion of the club head 20 that transitions into the crown 21 and side 22 of the club head 20, or, if there is no side 22 portion, the sole 23 of the club head 20, and reinforces and supports the hosel 10. The flange 18 is generally between 0.020 and 0.040 inch thick at the crown 21 and side 22 region. The flange 18 may also transition directly into the face, where dimensions can be thicker, such as from 0.040 to 0.050 inch. As shown in FIG. 6, the flange 18 is located immediately below the hosel 10 and bond section 40 (if there is one) and extends proximate at least part of the crown 21 and a side 22 of the club head 20. The flange 18 preferably is integrally formed with the club head 20, but in alternative embodiments it may be attached to reinforce the crown 21 and side 22 of the club head 20 after the club head is formed 20 and the hosel 10 assembled.

Figure 5:
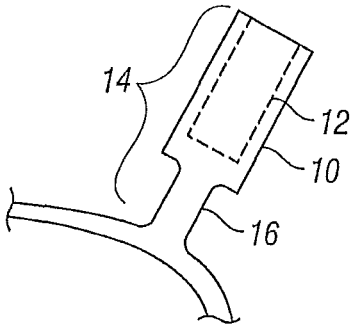
FIG. 5 is a plan view of a hosel according to a third embodiment of the present invention.

For both the partial and full 360-degree undercut embodiments, the undercut portion 16 may have different shapes along a vertical cross-section. For example, as shown in FIGS. 1-3 and 8, the undercut portion 16 may form a curved indentation in the hosel 10, or, as shown in FIGS. 4-5, the undercut portion 16 may form a polygonal indentation in the hosel 10. The curved indentation provides better performance than the polygonal indentation, however, as it is more bendable and minimizes stress risers that can be caused by a polygonal cross section.

The location of the undercut portion 16 with respect to the interior mold line (IML) of the golf club head 20 also affects the strength and bendability of the hosel 10. As discussed above, the IML of the hosel bore 12 preferably is located above the undercut portion 16 on the hosel 10 along a vertical z axis. Furthermore, the IML of the hollow interior 24 of the golf club head 20 may extend up into the hosel 10 as shown in the examples disclosed in FIG. 8. Specifically, examples A and D include an undercut portion 16 that encircles part of the golf club head IML 24. FIG. 6 also makes reference to excess mass 25 that can be removed from the golf club 20 interior to improve weighting. This structure allows for a lighter overall golf club head 20 weight because it maximizes the hollowness of the hosel 10 and the golf club 20 while at the same time providing a barrier 17 to keep particles from falling through the hosel bore 12 and into the interior portion of the club head 20.

Figure 3:
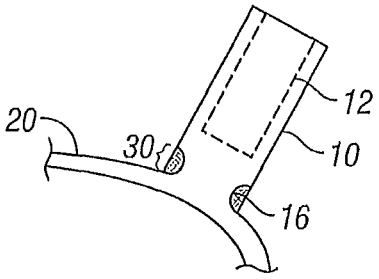
FIG. 3 is an enlarged view of a portion of the embodiment shown in FIG. 1 engaged with a split collar.

In both the partial and full undercut embodiments, and as shown in FIG. 3, a split collar 30 preferably is placed around the hosel 10 to cover the undercut 16 during use of the club head for aesthetic purposes. The split collar 30 also may be designed to prevent unwanted bending of the hosel 10. The split collar 30 may be sized to fill the undercut 16 portion with a light material, such as plastic or rubber, to further prevent bending of the hosel 10 during use of the golf club.

As discussed above, the golf club hosel diameter may vary more subtly than the undercut embodiments and still retain bendability and adjustability features. One manner of achieving this functionality is to taper the outer mold line (OML) from the top to the bottom of the hosel without interfering with the structural integrity of the hosel. The $U_L$ can be maximized when the hosel tapers gently in diameter instead of rapidly via an undercut 16. As such, the undercut 16 effectively is removed from the overall hosel design because $U_L$ increases to include the entire length of the hosel 10. The OML tapers from a larger outer dimension to a smaller outer dimension, and then may increase again after reaching a smallest outer dimension.

Figure 9:
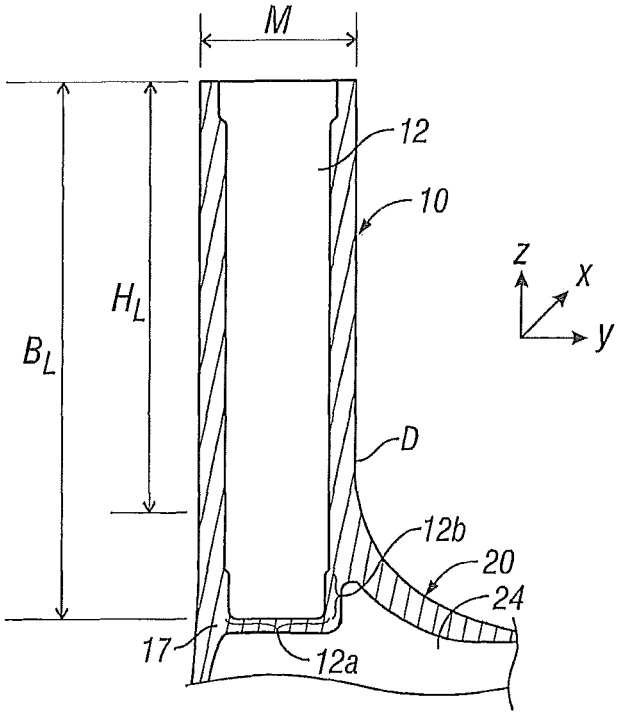
FIGS. 9-16 are cross-sectional views of other embodiments of the present invention.

FIG. 9 discloses the preferred embodiment of the present invention. In this embodiment, the hosel 10 width tapers from a maximum width "M" of 0.50 inch to a minimum width "D" of 0.47 inch at its narrowest point, and then increases again until it merges with the golf club head 20. The hosel 10 has an overall vertical length $H_L$ of approximately 0.90 inch. The hosel bore 12 IML extends toward the interior of the golf club head 20 such that the hosel bore 12 IML is encircled by the region of the hosel 10 having the smallest diameter D. The depth of the hosel bore 12 $B_L$ is approximately 1.53 inches.

Figure 12:
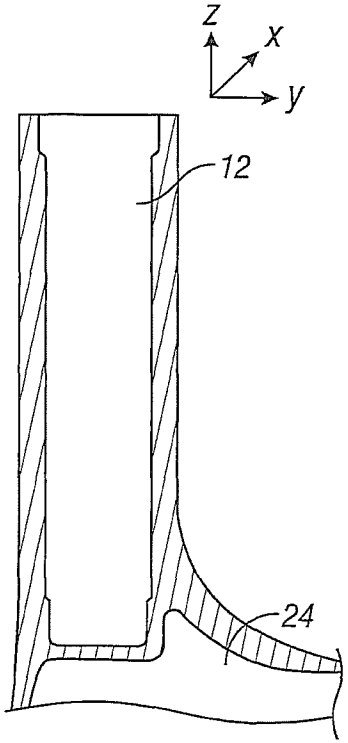

This embodiment further maximizes weight savings by including a golf club interior IML 24 that flanks the hosel bore 12 IML on two sides 12*a*, 12*b*, separated only by a barrier 17. The barrier 17 separating the hosel bore 12 IML from the golf club interior IML 24 is preferably 0.040 inch thick at side 12*a* and 0.029 inch thick at side 12*b*. Ultimately, this embodiment is preferred because it maximizes both the bendability of the hosel and the weight savings of the overall club head. FIG. 12 shows another embodiment that is similar to the one shown in FIG. 9.

Figure 10:
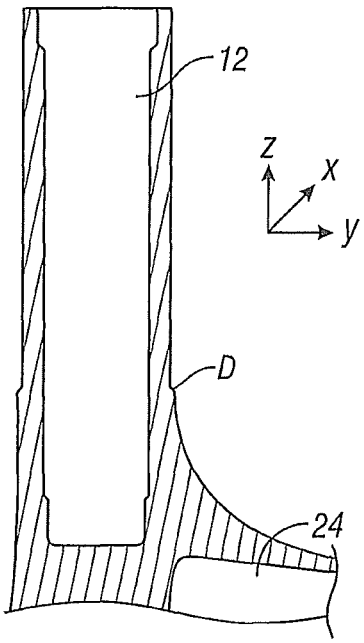
Figure 11:
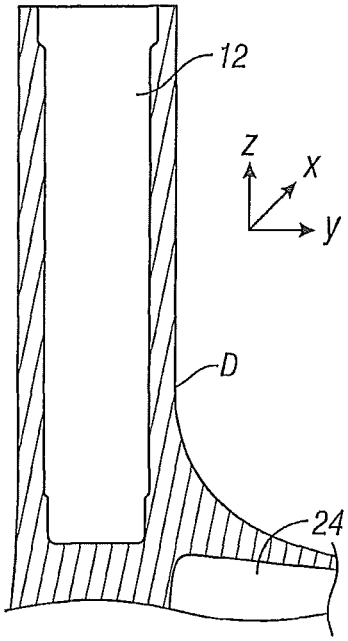

FIGS. 10 and 11 disclose other embodiments of the present invention. These embodiments include hosels 10 with a slightly decreased hosel bore 12 depth of 1.33 inches, instead of 1.53 inches. The hosel bores 12 of FIGS. 10 and 11 are not flanked by golf club interior IMLs 24. In both of these embodiments, the hosel bore 12 is encircled by the region of the hosel 10 having the smallest diameter D, which is 0.450 inch in the embodiment shown in FIG. 10 and 0.500 inch in the embodiment shown in FIG. 11.

Figure 14:
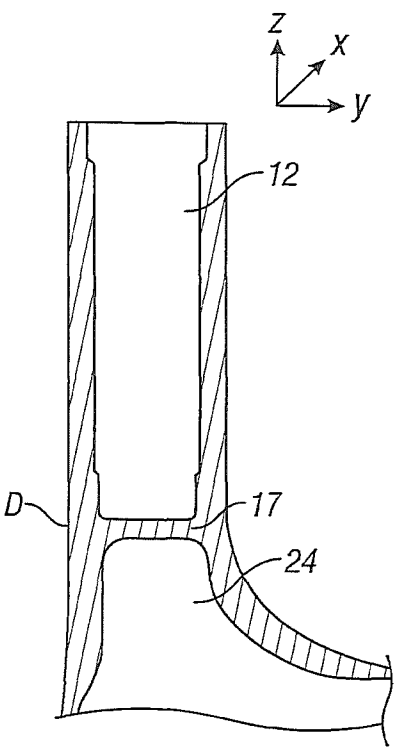
Figure 13:
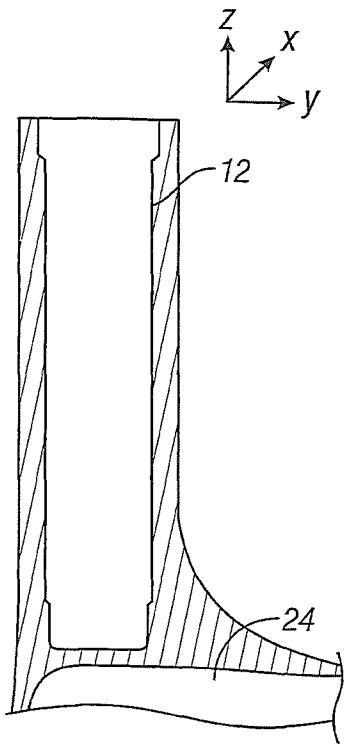
Figure 15:
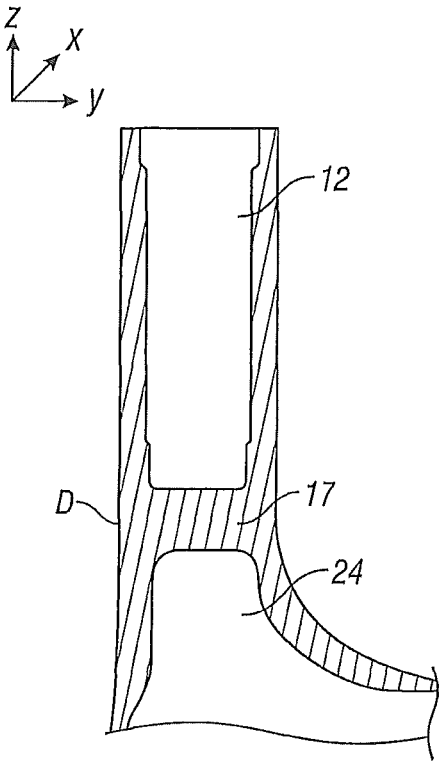
Figure 16:
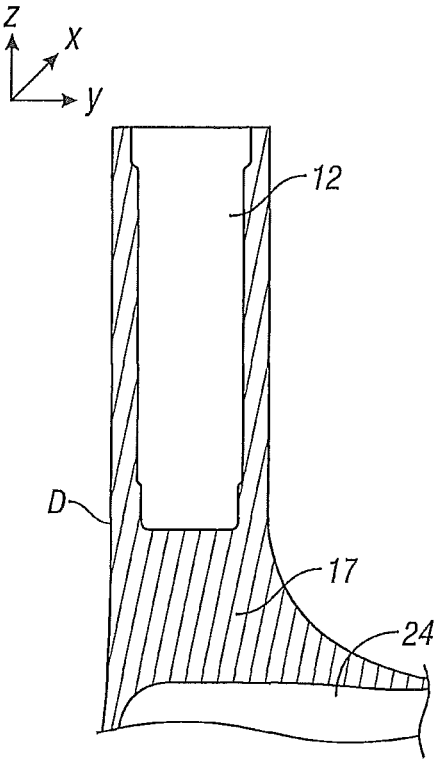

FIGS. 13-16 show embodiments of hosels 10 having hosel bores 12 that are flanked by golf club interior IMLs 24 on only one side. The overall IML of these embodiments are smaller than the overall IML of the embodiments shown in FIGS. 9 and 12 because more material is removed from the embodiments of FIGS. 9 and 12. Of FIGS. 13-16, FIGS. 14 and 15 maximize weight savings in the golf club head because the golf club interior IMLs 24 extend upwards into the hosel 10. The hosel bores 12 of the embodiments shown in FIGS. 14-16 are not encircled by the region of the hosel 10 having the smallest diameter D. Instead, the region having the smallest diameter D encircles the barriers 17 of these embodiments. The embodiments of FIGS. 14-16 have hosels 10 with longer overall length $H_L$, which improves hosel bendability due to the additional leverage provided by the greater overall hosel 10 length.

The embodiments disclosed in FIGS. 9 through 16 may also include features and dimensions described in connection with the undercut embodiments of the present invention, including a flange section 18 and a split collar 16.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim:

1. A golf club head comprising:

A head body comprising a hollow interior having a first interior mold line;

a hosel comprising a tube body comprising a portion of an undercut, a bore, and a barrier;

a flange section between the hosel and the head body with a second interior mold line;

wherein the bore has a length of at least one inch, is disposed entirely within the tube body, and is located above the undercut, wherein the flange comprises a portion of the undercut, wherein the undercut has a maximum cross section that decreases to a minimum cross section and increases to the maximum cross section, wherein the first interior mold line joins the second interior mold line, wherein the second interior mold line is disposed within the flange section above an interface between the flange section and the head body, wherein the undercut at least partially encircles the second interior mold line, and wherein the barrier is disposed between the bore and the second interior mold line.

2. The golf club head according to claim 1, wherein the flange section has a thickness of 0.020 to 0.050 inch.

3. The golf club head according to claim 1, wherein the undercut has a curved cross-sectional shape.

4. The golf club head according to claim 1, wherein the undercut has a polygonal cross-sectional shape.

5. The golf club head according to claim 1, wherein the undercut has an overall vertical length of 0.025 inch to 1.5 inch.

6. The golf club head according to claim 1, further comprising a split collar sized to cover the undercut.

7. The golf club head according to claim 6, wherein the split collar is composed of a material selected from the group consisting of plastic and rubber.

8. The golf club head according to claim 1, wherein the barrier has a thickness of approximately 0.040 inch.

* * * * *